United States Patent [19]

Masunaga et al.

[11] 4,125,090

[45] Nov. 14, 1978

[54] CONTROL METHOD AND SYSTEM FOR CAR-MOUNTED FUEL REFORMER

[75] Inventors: Kunihiko Masunaga, Okazaki; Masakatsu Kani, Toyota; Hirohiko Hoshi, Susono; Kazuhiko Ishiguro, Toyota, all of Japan

[73] Assignee: Toyota Jidosha Kogyo Kabushiki Kaisha, Aichi, Japan

[21] Appl. No.: 744,114

[22] Filed: Nov. 22, 1976

[30] Foreign Application Priority Data

Nov. 25, 1975 [JP] Japan ..... 50-140898

[51] Int. Cl.[2] ..... F02B 43/08

[52] U.S. Cl. ..... 123/3; 123/32 EA

[58] Field of Search ..... 123/1 A, 3, 119 E, 32 EA; 48/85, 87; 23/230 A, 253 A, 281; 431/12, 37, 90

[56] References Cited

U.S. PATENT DOCUMENTS

| | | | |
|---|---|---|---|
| 3,236,449 | 2/1966 | Brunner | 431/12 |
| 3,299,940 | 1/1967 | Phillips | 431/90 |
| 3,721,253 | 3/1973 | Remke | 23/253 A |
| 3,741,710 | 6/1973 | Nelson | 431/90 |
| 3,750,632 | 8/1973 | Zechnall | 123/117 R |
| 3,766,897 | 10/1973 | Husted | 123/103 R |
| 3,814,570 | 6/1974 | Guigues | 431/12 |
| 3,915,125 | 10/1975 | Henkel | 123/119 A |
| 3,933,135 | 1/1976 | Zillman | 123/122 F |

FOREIGN PATENT DOCUMENTS

| | | | |
|---|---|---|---|
| 1,441,039 | 6/1976 | United Kingdom | 123/3 |

*Primary Examiner*—Charles J. Myhre
*Assistant Examiner*—Craig R. Feinberg
*Attorney, Agent, or Firm*—Oblon, Fisher, Spivak, McClelland & Maier

[57] ABSTRACT

A control method and system for efficient operation of an internal combustion engine by controlling the volume of gas mixture supplied from a car-mounted fuel reformer to the internal combustion engine and the mixing ratio, as well as the volumes of air and fuel supplied to the car-mounted fuel reformer. To be more specific, efficient operation of the internal combustion engine is provided by controlling the mixing ratio of air and liquid fuel supplied to a car-mounted fuel reformer, which produces a hydrogen-containing gas from a liquid fuel through the reaction of partial oxidation, and at the same time adding a controlled volume of air to the hydrogen-containing gas discharged from the car-mounted fuel reformer and supplying the resultant mixture of the hydrogen-containing gas and air to the engine.

9 Claims, 4 Drawing Figures

CONTROL METHOD AND SYSTEM FOR CAR-MOUNTED FUEL REFORMER

BACKGROUND OF THE INVENTION

1. Field of Invention

The present invention relates generally to a control method and system for a device to be connected to the internal combustion engine of a vehicle, especially an automobile, which supplies a reformed fuel to the internal combustion engine.

2. Description of the Prior Art

A partial oxidation method has been available for reforming a liquid fuel, but the reaction in this method being an exothermic one, causes heavy loss of the energy in the liquid fuel, resulting in an increased consumption of fuel. A gas yielded through reformation of fuel, hereafter called "reformed gas," unlike a liquid fuel, such as gasoline, possesses a very wide range of combustion and a high octane value. Thus, use of a reformed gas as a fuel, with appropriate selection of an internal combustion engine and appropriate combination with a car-mounted fuel reformer, hereafter called "reformer," will bring about an increased overall efficiency of energy utilization and a saving of fuel consumption. The main component of hydrocarbons in the reformed gas is methane ($CH_4$). Since methane ($CH_4$) is poor in photochemical reactivity and stable in combustability, when used at the same rate of air excess as gasoline, methane will lower the content of hydrocarbons in the exhaust gas. Moreover, when the reformed gas is burned as a lean mixture, the generation of harmful components in the exhaust gas, such as nitrogen oxides and carbon monoxide, can be substantially inhibited.

Namely, operation with a combination of a reformer and an internal combustion engine will be far more advantageous than operation with a direct supply of liquid fuel, like gasoline or gaseous low-class hydrocarbons, to the internal combustion engine, but an appropriate control is needed for this purpose.

Now the reformer is to be considered. Partial oxidation of n-heptane, as an example of liquid fuel, can be expressed by:

$$C_7H_{16} + 3.5O_2 - 7CO + 8H_2$$

(calorific value: 146 Kcal/mol)

The air/fuel ratio in this reaction is about 4.8. It is known that the air/fuel ratio has to be slightly higher than the above value for the purpose of maximizing hydrogen generation, but this is restricted by the material quality of the reformer, the lower limit of the optimum reaction temperature, and segregation of carbon and thermal efficiency, while for this purpose of adapting the reformed gas to the internal combustion engine, the calorific value per unit volume and the octane value of the reformed gas have to be limited. Only when all these conditions are satisfied can lean-burning, which characterizes the reformed gas, take place efficiently and effectively. Thus, to give full play to the merit of the reformed gas, the operating condition of the reformer has to be swiftly and properly changed, corresponding to changes in the running conditions of the internal combustion engine, such as, for example, the rpm thereof.

Generally, the reaction temperature, the air/fuel ratio and the reaction volume (material supply rate) in the reformer have influence on the quality and quantity of the reformed gas. For instance, the driver, when he wants an increase in the output of the engine, has to increase the air inflow to the reformer and, depending on the air inflow, also increase the supply of liquid fuel. Meanwhile, for the sake of increased output of the engine, it is desirable not only that the supply of the reformed gas to the engine be increased, but also that the calorific value of the reformed gas per unit volume be also increased. Thus, it is necessary to increase the rate of air inflow to the reformer and decrease the air/fuel ratio. In this way, not only the calorific value per unit volume of the reformed gas generated in the reformer can be increased, but also excessive rise in the reformer temperature can be prevented.

On the contrary, the driver, when he wants a decrease in the engine output, has to decrease the rate of air inflow to the reformer and at the same time decrease the supply of liquid fuel to the reformer. Thereby, since a decrease in the reaction volume is liable to lower the catalyst bed temperature, it is desirable that the air/fuel ratio be increased to prevent a temperature drop.

Thus, in a practical run, the reformer is required to perform an extremely wide range of reactions and, understandably, the air/fuel ratio has to be changed depending on the reaction volume.

Next, the control of gas drawn into the engine is to be considered. The air/fuel ratio of the gas mixture to be burned in the engine is desirably changed to correspond to the running conditions. The internal combustion engine burns a reformed gas generated in a reformer or a liquid fuel which does not pass the reformer or a mixture of these two. When a reformed gas generated in the reformer or a mixture of such with a conventional liquid fuel is employed, the burning range is greatly enlarged, thus enabling lean-burning. Thus, the contents of harmful components, especially of nitrogen oxides, in the exhaust gas can be substantially decreased, while, at the same time, the fuel consumption per unit output can be decreased, as is well-known. However, gaseous fuel, like the reformed gas, is characteristically poor in drawing or sucking efficiency and, accordingly, the maximum output drops unavoidably in the practical range of air/fuel ratios. For this reason, the driver, when he wants a high output, reduces the air/fuel ratio in the gas mixture to be drawn into the engine; increases the air/fuel ratio in the practical working range; and, in a very low speed range or in an idling condition, he increases the air/fuel ratio further or decreases the air/fuel ratio with the throttle valve closed. Thus, control of the ratio of air and fuel drawn into the engine is far more complicated than in the reformer.

For this reason, it is necessary to develop a method and system by which the driver can swiftly and properly effect the aforementioned complicated control by a simple manipulation.

SUMMARY OF THE INVENTION

Accordingly, a primary object of the present invention is to recognize the driver's consciousness of driving and to effect a change in the volume of air inflow to the reformer according to such recognized consciousness or, in other words, to link the driver's handling of an output control device, such as an accelerometer, directly and instantly with the action of the reformer.

Another object of the present invention is to computerize the action of the whole reformer system to attain the constructive transfer of the driver's consciousness of driving into a corresponding change in volume of the air flow into the reformer.

Yet another object of the present invention is to provide preferential control of the composition of a reformer-generated gas, thereby preventing undesirable phenomena in the reformer, such as overheating, overcooling and carbon segregation.

Still another object of the present invention is to control the air inflow to a reformer, thereby increasing the calorific value per unit volume of the gaseous fuel generated in the reformer.

Still another object of the present invention is to provide a fine control of a whole reformation system by automatically and exactly maintaining the ratio of air and fuel supplied to the reformer and the ratio of the gaseous fuel generated in the reformer and supplied to the internal combustion engine and the air drawn thereinto.

Still another object of the present invention is to cause leanburning of a reformed gas from a reformer, thereby minimizing the harmful contents in the exhaust gas, such as nitrogen oxides and carbon monoxide.

The foregoing and other objects are attained by the present invention which provides a control method and system for swiftly adapting the air/fuel ratio of a reformer and the air/fuel ratio of an internal combustion engine connected to the reformer, respectively, to the optimum conditions therefor by converting the driver's consciousness of driving output requirements into terms of a changing air inflow to the reformer. In other words, it is so arranged that his consciousness of driving can be sensitively reflected directly as a rise or fall in the volume of air inflow to the reformer. Information on a rise or fall in the volume of air inflow is processed by a computer to optimize the volume of liquid fuel supplied to the reformer and the composition and volume of the gas mixture drawn into the internal combustion engine.

BRIEF DESCRIPTION OF THE DRAWINGS

Other objects, features and attendant advantages of the present invention will be more fully appreciated as the same becomes better understood from the following description when considered in connection with the accompanying drawings wherein.

DETAILED DESCRIPTION OF THE PREFERRED EMBODIMENT

Figure 1:
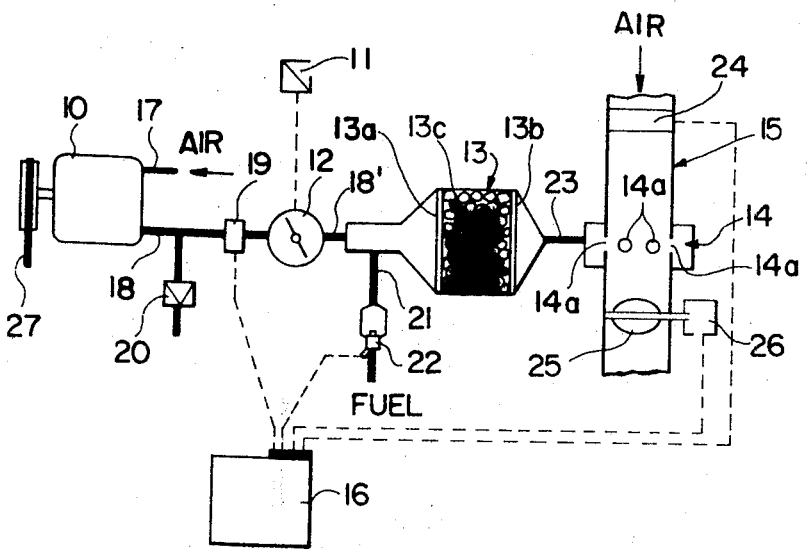
FIG. 1 is a schematic view of a preferred embodiment of the present invention.

Referring now to the Drawings, and more particularly to FIG. 1, there is shown a general composition of a car-mounted fuel reformer system, the major components of which are an air pump 10, a valve 12 interlocked mechanically or electrically with an accelerator pedal 11, a reformer 13, an air pipe 15 equipped with a mixer 14, and a computer 16. The air pump 10 comprising an air suction pipe 17 and a blower pipe 18 is given a torque via a belt 27 from the internal combustion engine, not shown. The blower pipe 18 is connected via a flowmeter 19 to the valve 12 and has attached thereto a pressure adjustment valve 20. By setting this valve 20 at a desired pressure, for instance about 0.6 kg/cm$^2$, the air pressure in the blower pipe 18 can be desirably adjusted. The valve 12 is connected to the air intake of the reformer 13 through a pipe member 18'. The liquid fuel intake of the reformer 13 is connected to a liquid fuel supply pipe 21, which is fitted with a blow rate control valve 22, for instance, and electromagnetic valve. A reformed gas jet pipe 23 at the outlet of the reformer 13 is connected to the mixer 14 attached to the air pipe 15. The reformed gas goes through the reformed gas jet hole **14*a* opening provided in air pipe 15 and then into the air pipe 15 itself. In the upstream part of the air pipe 15 there is disposed an air flowmeter 24 and in the downstream part of the air pipe 15 there is disposed a butterfly valve 25. The butterfly valve 25 interlocks with a servo-motor 26 for being opened and closed. The upstream end of the air pipe 15 connects to an air cleaner, not shown, while the downstream end connects to the intake manifold of an internal combustion engine, also not shown. The flowmeter 19, the flow rate control valve 22, the air flowmeter 24 and the servo-meter 26 are respectively connected to the computer 16**.

During the starting phase of the operation of the present invention, air flowmeter 24 generates a signal to the computer 16 and, in turn, to servo-motor 26 which serves to open butterfly valve 25 so as to allow for a proper secondary air and reformer gas mixing with introduction into the internal combustion engine for the purpose of starting the same. Furthermore, the mixing ratio of the reformed gas and the secondary air which are supplied into the air pipe 15 can be controlled by varying the opening degree of the butterfly valve 25, thus maintaining the total ratio of air and fuel, which are fed into the internal combustion engine, at a constant level. Control of the opening degree of butterfly valve 25 is accomplished by servo-motor 26 as controlled by the computer 16.

At the starting phase of the internal combustion engine, a driver depresses the accelerator pedal 11 to open valve 12, thereby introducing air into the reformer 13 through the air pump 10. Then, the volume of air supplied to the reformer 13 is detected by the flow meter 19 and the thus detective value is transmitted to the computer 16. The computer 16 controls the control valve 22 according to the detected value of the flowmeter 19, thus adjusting the amount of fuel supplied to the reformer through the control valve 22 to the volume of air supplied to the reformer 13, so as to maintain the air/fuel ratio in the reformer 13 at constant level. The amount of the reformed gas generated by the reformer 13 is proportional to the air amount detected by the flowmeter 19.

On the other hand, the amount of the secondary air detected by the flowmeter 24 is transmitted to the computer 16. According to the thus detected value of the secondary air, the computer 16 controls the opening degree of the butterfly valve 25, thereby maintaining the total air/fuel ratio of the mixing gas composed of the reformed gas and the secondary air, which are both supplied into the air pipe 15, at a constant level.

Figure 2:
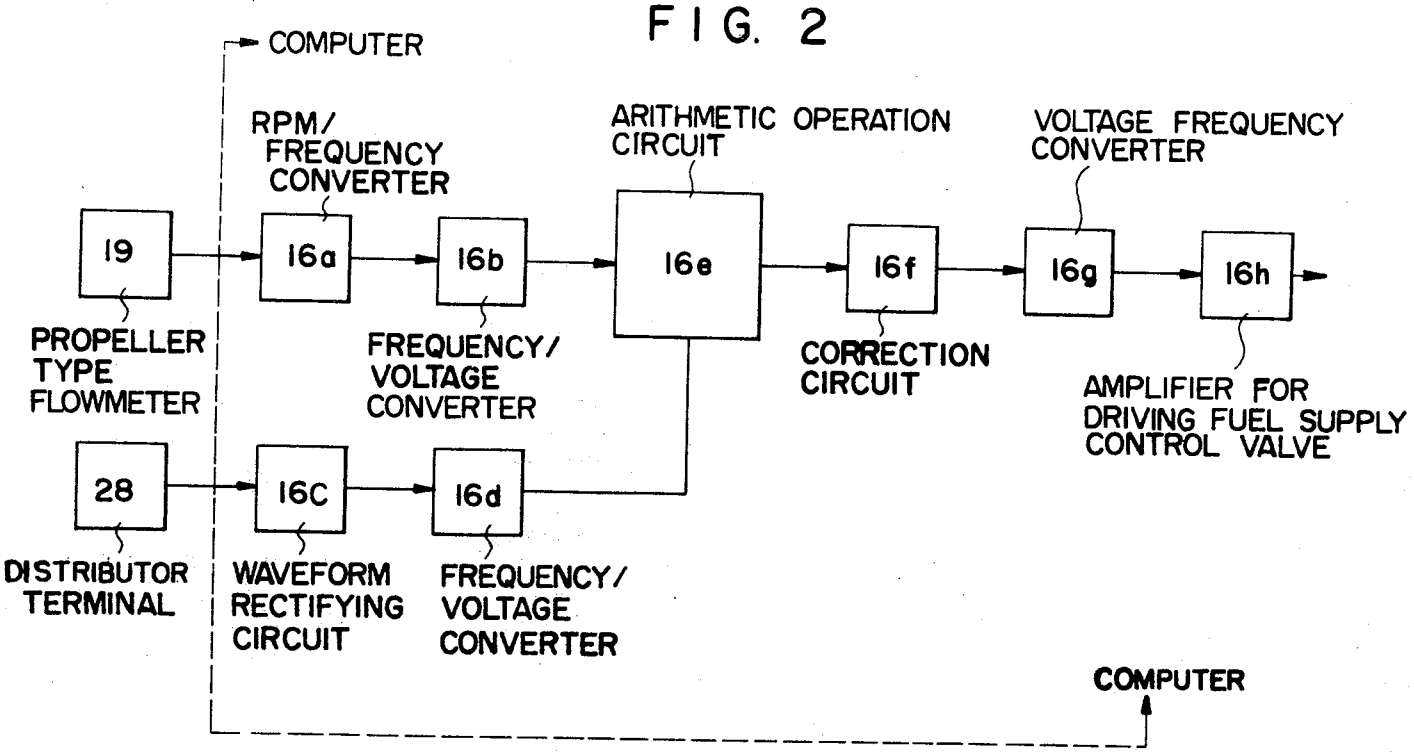
FIG. 2 shows a basic configuration of a computer to be used in the embodiment of the present invention shown in FIG. 1.
Figure 3:
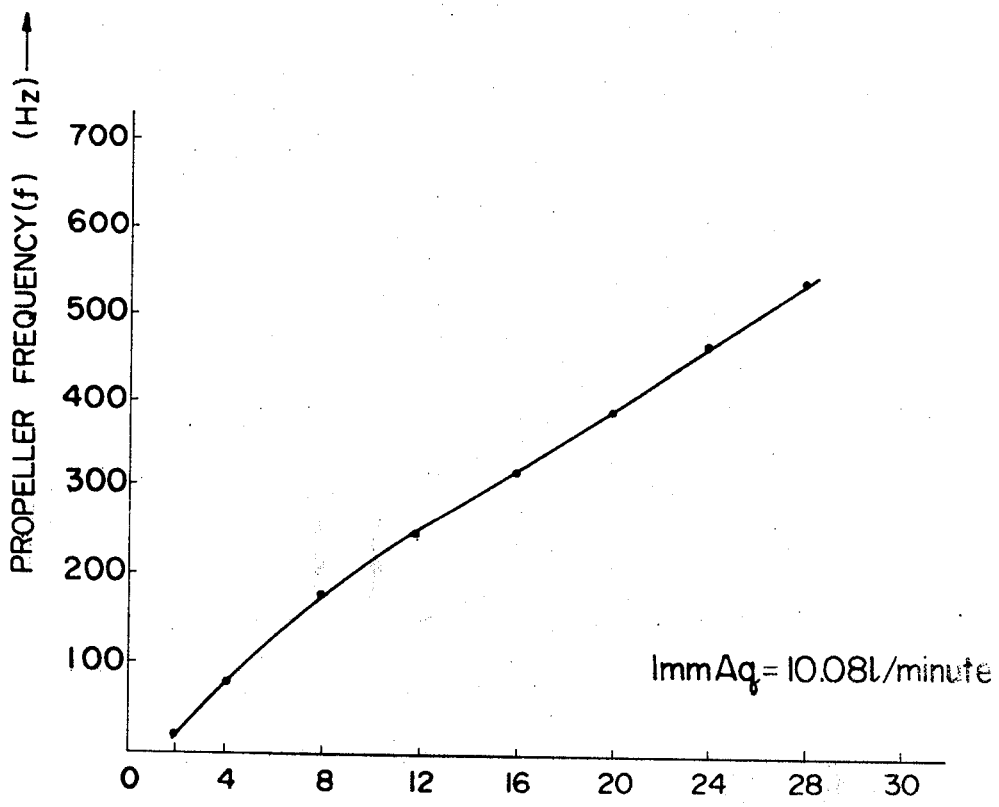
FIG. 3 is a characteristic diagram illustrating the relation between the propeller frequency and the drawn air volume.
Figure 4:
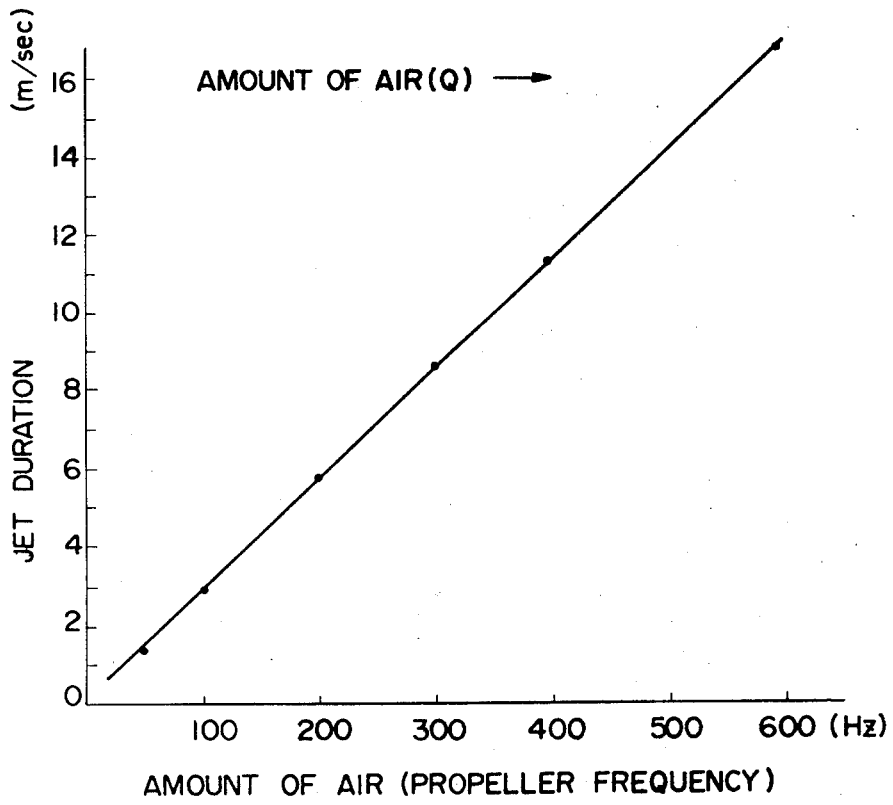
FIG. 4 is a characteristic diagram illustrating the relation between the jet duration and the propeller frequency.

The reformer 13 may be a conventional one, for instance the one illustrated in FIG. 1, in which a granullar catalyst **13*c* is inserted between two opposed metal screens 13*a*, 13*b*. The flowmeter 19 provided midway in the blower pipe 18, which is intended for measurement of a relatively low flow rate, may be a propeller type flowmeter, but is not limited to being propeller type. In the propeller type flowmeter 19, a proportional relation, as illustrated in FIG. 3, holds between the volume of air flowing in the blower pipe 18 and the propeller frequency or rpm. The rpm of the propeller type flowmeter is fed to the computer 16, which calculates the necessary supply of fuel. The propeller rpm is converted to a frequency signal in an rmp/frequency transducer 16***a*, shown in FIG. 2, consisting of a radiative diode-photo transistor. The frequency signal is then converted to a voltage signal in a frequency/voltage transducer 16*b* and the voltage signal goes into an arithmetic operation circuit 16*e*. Meanwhile, the engine rpm signal from a distributor terminal 28 has its waveform rectified in a waveform rectifying circuit 16*c* and is converted to a voltage signal in a frequency/voltage transder 16*d*, which signal goes into the arithmetic operation circuit 16*e*. In the arithmetic operation circuit 16*e*, the signal from the propeller type flowmeter 19 is divided by the signal from the distributer terminal 28, thereby giving the air flow rate in each revolution of the engine. From the present diagram of fuel jet duration vs. air volume, the necessary fuel jet duration can be found, as illustrated in FIG. 4. The fuel jet duration signal is then sent to a correction circuit 16*f*, where it is added with various factors to give a more appropriate fuel jet duration signal, which is then converted to a frequency signal by a voltage/frequency transducer 16*g*. The frequency signal is sent to a fuel supply control valve drive amplifier 16*h*, where it is changed to an output with enough power to drive the fuel flow rate control valve 22. The opening of this valve 22 is set depending on this output. When this valve 22 is electromagnetic valve, the open-close timing of the valve will depend on this output.

In operation, the torque of an internal combustion engine, not shown, is directly or indirectly, through a transmission member like belt 27, transmitted to the air pump 10. The primary air supplied from the air pump 10 is set to a desired pressure, as already indicated, by the pressure adjust valve 20 and this air is introduced through the flowmeter 19 and the valve 12 into the reformer 13. Upon the output control device 11, for instance the accelerator pedal, being operated by the driver, the valve 12 interlocked therewith acts to control the flow rate of primary air, increasing the flow rate when the output is to be increased. The flow rate of primary air is converted to an electrical signal at the flowmeter 19. When this signal is fed to the computer 16, a control valve, such as the electromagnetic valve 22, provided in the fuel supply pipe 21, reacts to this signal, thereby controlling the flow rate of liquid fuel and supplying the fuel to the reformer 13. At the same time the flowmeter 24 provided in the air pipe 15 converts the flow rate of the drawn secondary air to an electrical signal, which is then fed to the computer 16. The servo-motor 26 reacts to this signal and causes the valve 25 in the air pipe 15 to control the volume of drawn air such that the air/fuel ratio of the gas mixture supplied to an internal combustion engine, not shown, may settle to a value corresponding to the volume of gaseous fuel flowing in through the mixer or venturi 14. In this way, the driver can swifly and adequately control the operating condition of the reformer and the internal combustion engine by mere operation of the output control device, or more simply, the accelerator pedal. Thus, the practical value of the present invention is extremely high.

According to the present invention, in which the whole system is placed under the control of a computer, fine control is practicable, the exhaust gas can be clean, fuel consumption can be decreased, and with the composition of the gaseous fuel produced in the reformer being preferentially controllable, the reformer can be maintained at the right temperature and segregation of carbon can be prevented.

The internal combustion engine which burns a gaseous fuel, which contains much hydrogen and contains carbon monoxide or methane as the main combustible element, is more heavily affected by the calorific value of fuel than by the air/fuel ratio. Therefore, according to the present invention, which can swiftly control the composition of gaseous fuel, an internal combustion engine can run under different conditions without misfiring or stopping. Moreover, since the air/fuel ratio can be finely adjusted, the air/fuel ratio can be very smoothly held at a present value.

The effect of applying the present invention is illustrated in the following example:

Experimental Conditions

Road : flat, smooth
Vehicle : passenger car weighing 1,100 Kg
Internal combustion engine : 1,600 cc 4-cylinder
Reformer : partial oxidation type
Catalyst : nickel
Liquid Fuel : non-leaded gasoline

| | Experimental results | | | |
|---|---|---|---|---|
| Car speed (km/hr) | Output (ps) | $NO_x$ (ppm) | Catalyst temp. (° C) | Air/fuel ratio in reformer (weight ratio) |
| 30 | 2.2 | 90 | 850 | 5.2 |
| 60 | 7.2 | 110 | 870 | 4.5 |
| 90 | 13.8 | 205 | 950 | 3.8 |

In the above example, it is designed that with an increased volume of air inflow to the reformer, the air/fuel ratio may gradually drop. As is evident from the above table, even when the engine rpm rises and the load is increased, the $NO_x$ content of the exhaust gas is held at a low level and the catalyst temperature is in the range of 800° C. ~ 1,100° C. in which the catalyst can be highly active.

Depending on the structure and material quality of the reformer practically employed, the air/fuel ratio should be properly corrected. For instance, the air/fuel ratio under maximum load is restricted by the highest allowable temperature of the catalyst or structural material, the reaction volume, the calorific capacity of the reformer, etc., while the air/fuel ratio under minimum load is restricted by the lowest allowable reaction temperature necessary for reforming reaction. Further, the air/fuel ratio under medium output is affected by a change in the engine output depending on the composition of gaseous fuel produced by reforming and by a change in the composition of exhaust gas. Moreover, these air/fuel ratios under maximum and minimum loads may be re-corrected.

As many apparently widely different embodiments of this invention may be made without departing from the spirit and scope thereof, it is to be understood that within the scope of the appended claims the invention may be practiced otherwise than as specifically described herein.

What is claimed as new and desired to be secured by Letters Patent of the United States is:

1. A control method for a car-mounted fuel reformer comprising the steps of:

adjusting a volume of primary air flowing into a reformer, which produces a hydrogen-containing reformed gas through partial oxidation, and simultaneously converting the volume of primary air inflow into a first electric signal;

optimizing a supply of liquid fuel to the reformer by means of a computer to which said first electrical signal is fed;

adjusting the composition and volume of reformed gas produced in the reformer, and simultaneously converting a drawn volume of secondary air to be supplied to an internal combustion engine into a second electrical signal;

feeding said second electrical signal to said computer;

controlling said drawn volume of secondary air by said second electrical signal fed to said computer; and mixing the reformer gas and the secondary air in appropriate desirable proportions for meeting various driving conditions according to the signals provided.

2. A control method for a car-mounted fuel reformer comprising the steps of:

adjusting the flow rate of a primary air fed into the reformer by means of a first valve which interlocks with an output control device;

converting the measured flow rate of said primary air into a first electrical signal;

determining the injection duration of an injector by means of a computer to which said first electrical signal corresponding to said primary air is fed, thereby controlling the a volume of liquid fuel supplied to the reformer;

producing mixture gas under a constant air/fuel ratio by mixing said liquid fuel with said primary air;

producing reformed gas from said mixture gas by a partially oxidizing reaction of said reformer;

supplying said reformed gas into an air pipe means connected to an intake manifold producing a measured flow rate of secondary air for an internal combustion engine;

converting the measured flow rate of the secondary air into a second electrical signal;

feeding said second electrical signal corresponding to said secondary air flow rate to said computer;

condinating said flow rates of said primary air, secondary air and the supply volume of said liquid fuel of the injector by means of said computer, thereby controlling a second valve disposed in said air pipe means by a control signal generated from said computer; and mixing said secondary air and said reformed gas, which are drawn into said air pipe means by controlling motion of said second valve, under a constant air/fuel ratio to produce mixing gas.

3. A control system for a car-mounted fuel reformer as set forth in claim 2, wherein said primary air supplying device comprises an air pump means and a pressure adjustment valve.

4. A control system for a car-mounted fuel reformer as set forth in claim 2, wherein said mixer comprises a venturi means having reformed gas jet holes operatively connected to said reformer.

5. A control system for a car-mounted fuel reformer comprising:

an air pipe means, including a venturi-tube, which is connected to an intake manifold of an internal combustion engine, said air pipe means constituting a first flowmeter upstream of the venturi-tube and having a throttle valve downstream thereof;

a reformer connected to said venturi-tube;

a primary air supply source connected to said reformer;

a second flowmeter and valve means provided between said primary air supply source and said reformer, said second flowmeter serving to convert the air flow into a signal;

a fuel supply source connected to said reformer;

an output control device connected to said valve means and controlling said valve means; and a computer operable in response to the action of the second flowmeter and valve means wherein the flow rate of primary air controlled by said output control device is converted into a signal by said second flowmeter; the supply of fuel from the source of the reformer being controlling by said signal, and at the same time, the flow rate of air drawn into the air pipe means being converted into a signal by said flowmeter of the air pipe means, and the opening of a throttle valve being automatically adjusted in accordance with said last mentioned signal.

6. A control system for a car-mounted fuel reformer as set forth in claim 5, wherein a blower pipe for said primary air is connected to an air pump interlocked with the torque of the internal combustion engine.

7. A control system for a car-mounted fuel reformer as set forth in claim 5, wherein said blower pipe is equipped with a pressure adjusting valve.

8. A control system for a car-mounted fuel reformer as set forth in claim 5, wherein said venturi-tube constitutes a mixer.

9. A control system for a car-mounted fuel reformer comprising:

a primary air supplying device interconnected with an internal combustion engine;

a reformer connecting to said primary air supplying device and containing a catalyzer;

a first flowmeter interconnected between said primary air supplying device and said reformer;

means for converting flow rate of said primary air measured by said first flowmeter into a first electrical signal;

an output control device;

valve means, connected between said primary air supplying device and said reformer and interconnected with the output control device, to adjust said flow rate of the primary air;

means for supplying liquid fuel to be mixed with said primary air;

air pipe means including a mixer member connected with said reformer and connected to an intake manifold of the internal combustion engine;

a second flowmeter connected to the air pipe means for measuring flow rate of the secondary air drawn into said air pipe means;

means for converting the flow rate of said secondary air measured by said flowmeter into a second electrical signal;

second valve means disposed downstream of said air pipe means and operably interconnected with a servometer;

a computer operable in response to said first and second electrical signal and interconnecting said second flowmeter and said servometer for controlling the supply duration of said liquid fuel in accordance with said flow rate of the primary air fed into the computer as said first electrical signal and controlling said second valve means as a function of the flow rates of said primary and secondary air and as a function of the supply volume of said liquid fuel fed into the computer as said second electrical signal.

* * * * *